United States Patent [19]

Imai

[11] Patent Number: 4,508,446

[45] Date of Patent: Apr. 2, 1985

[54] REPRODUCTION PROCESS CONTROL METHOD

[75] Inventor: Chikara Imai, Tokyo, Japan

[73] Assignee: Ricoh Company, Ltd., Japan

[21] Appl. No.: 465,327

[22] Filed: Feb. 9, 1983

[30] Foreign Application Priority Data

Feb. 9, 1982 [JP] Japan ..... 57-19220
Jun. 18, 1982 [JP] Japan ..... 57-104873
Jun. 18, 1982 [JP] Japan ..... 57-104874

[51] Int. Cl.[3] ..... G03G 15/00

[52] U.S. Cl. ..... 355/14 R; 355/14 D; 355/14 E; 355/14 CH

[58] Field of Search ..... 355/3 R, 3 CH, 3 DD, 355/14 FU, 14 R, 14 CH, 14 D, 14 E; 219/216

[56] References Cited

U.S. PATENT DOCUMENTS 4,162,847 7/1979 Brandon ..... 355/14 FU
4,324,486 4/1982 Nishikawa ..... 219/216 X
4,373,802 2/1983 Yuge et al. ..... 355/14 C X
4,435,677 3/1984 Thomas ..... 355/14 FU

*Primary Examiner*—A. C. Prescott
*Attorney, Agent, or Firm*—Guy W. Shoup

[57] ABSTRACT

A method for controlling an electrophotographic copying process in order to maintain the quality of copy images uniform as well as excellent even if the gamma characteristics of a photosensitive member including a photoconductive material such as AsSe or halogen doped SeTe has been changed due to changes in temperature of the photosensitive member is provided. A main feature of the method resides in using different combinations of process variables including charging amount, exposure amount and developing bias voltage level depending upon whether the temperature of the photosensitive member goes higher or lower than a predetermined reference level.

5 Claims, 8 Drawing Figures

REPRODUCTION PROCESS CONTROL METHOD

BACKGROUND OF THE INVENTION

1. Field of the Invention

This invention relates to a method for controlling a reproduction process, and in particular, to a method for controlling an electrophotographic copying process thereby allowing to maintain the copying characteristics at constant in spite of occurrence of changes in operating conditions.

2. Description of the Prior Art

In an electrophotographic copying process, use is usually made of a photosensitive member comprised of a photoconductive material which changes its characteristics depending upon temperature. One of the main temperature depending characteristics is the so-called gamma characteristic which relates to the potential of an electrostatic latent image formed on the photosensitive member. Such changes in the gamma characteristic are undesirable because they will adversely affect the quality of a resulting copy image. In general, the temperature inside a copying machine increases as the copying machine is used for an extended period of time. For example, in a cold district, such a temperature increase inside a copying machine is often found to range between 20° and 30° C. Accordingly, the temperature of the photosensitive member also increases by 20°–30° C. Under the circumstances, it is necessary to control a copying process suitably so as to allow to obtain copy images of uniform and excellent quality despite of temperature changes in the photosensitive member.

In accordance with a typical prior art copying process control method, a reference temperature is determined from a photosensitive member to be used and at the same time reference operating conditions for process variables such as the amount of uniform charging, the amount of exposure and the level of developing bias voltage are predetermined in consideration of the reference temperature. One or more of such process variables are selected and the thus selected process variables are varied depending upon the difference between the current temperature of the photosensitive member and the reference temperature by detecting the temperature of the photosensitive member. However, such a prior art approach is not always satisfactory partly because the process variables to be changed depending upon temperature changes of the photosensitive member are fixed and temperature-dependent characteristic changes of a photosensitive member involve a rather complicated mechanism.

SUMMARY OF THE INVENTION

The disadvantages of the prior art are overcome with the present invention and an improved method for controlling a copying process so as not to be adversely affected by temperature changes is provided. In accordance with one aspect of the present invention, there is provided a method for controlling a copying process, which uses a photosensitive member and includes at least the steps of uniformly charging said photosensitive member, exposing an image to the thus charged photosensitive member to form an electrostatic latent image thereon and developing the latent image, by changing process variables regarding said copying process depending upon the temperature of said photosensitive member, said process variables to be changed including at least the amount of uniform charging, the amount of exposure and the level of developing bias voltage and a reference temperature being predetermined for said photosensitive member, said method comprising the steps of: detecting the temperature of said photosensitive member to determine whether the detected temperature is above or below said predetermined reference temperature; and changing a first group of process variables when the detected temperature has been found to be above said reference temperature; whereas changing a second group of process variables different in combination from said first group of process variables when the detected temperature has been found to be below said reference temperature.

For example, in the case where the photoconductive material forming the photosensitive member is AsSe, the amount of exposure is decreased from its predetermined reference operating condition if the detected temperature has been found to be above the reference temperature of the photosensitive member; on the other hand, the level of the developing bias voltage and the amount of uniform charging are increased from the predetermined reference operating conditions if the detected temperature has been found to be below the reference temperature. Furthermore, in the case where the photoconductive material forming the photosensitive member includes halogen doped Se-Te, the level of the developing bias voltage is increased from its predetermined reference operating condition if the detected temperature has been found to be above the reference temperature of the photosensitive member; on the other hand, the amount of uniform charging is increased from its predetermined reference operating condition if the detected temperature has been found to be above the reference temperature. In this manner, in accordance with the present invention, predetermined different combinations of process variables such as amount of uniform charging, amount of exposure and level of developing bias voltage are varied depending upon whether the current temperature of the photosensitive member is above or below the reference temperature.

Therefore, it is a primary object of the present invention to provide an improved method for controlling a copying process using a photosensitive member comprised of a photoconductive material which changes its characteristics depending upon temperature.

Another object of the present invention is to provide a reproduction process control method for allowing to obtain copy images of uniform quality even if the temperature of the photosensitive member varies.

A further object of the present invention is to provide a method for controlling an electrophotographic copying process in accordance with the temperature of the photosensitive member by changing different kinds of process variables depending upon whether the detected temperature of the photosensitive member is higher or lower than a predetermined reference temperature.

Other objects, advantages and novel features of the present invention will become apparent from the following detailed description of the invention when considered in conjunction with the accompanying drawings.

DESCRIPTION OF THE PREFERRED EMBODIMENTS

Figure 1:
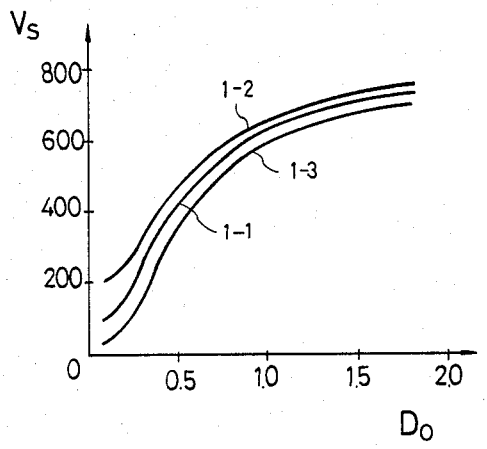
FIG. 1 is a graph showing the temperature dependent characteristics of an AsSe photosensitive member with the abscissa taken for image density $D_O$ of an original image and the ordinate taken for surface potential $V_S$ of the photosensitive member.

FIG. 1 graphically shows the relation between the image density of an original image and the surface potential of a photosensitive member including AsSe as a photoconductive material, or the gamma characteristic in the potential of an electrostatic latent image. In the graph of FIG. 1, three curves are shown and the curve denoted by 1-1 indicates the characteristic when the temperature of the photosensitive member is 25° C., which is determined as a reference temperature in the present specification. Similarly, the curves 1-2 and 1-3 indicate the characteristics when the photosensitive member is at 15° C. and 35° C., respectively.

Figure 2:
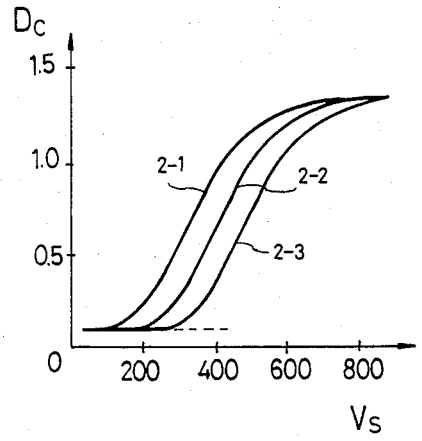
FIG. 2 is a graph showing the gamma characteristics in magnetic brush developing with the abscissa taken for the surface potential $V_S$ of the photosensitive member and the ordinate taken for image density $D_C$ of a copy image.

FIG. 2 is a graph showing the developing characteristics of a magnetic brush developing device using dry two component (toner and carriers) developer, or the relation between the surface potential of the photosensitive member including AsSe as a photoconductive material and the image density of a copy image, with the developing bias voltage as a parameter. In FIG. 2, the curves 2-1, 2-2 and 2-3 correspond to the developing bias voltages 150 V, 250 V and 350 V, respectively. As shown, the copy image density approaches a saturation level at a high image density region; whereas, it approaches a constant level at a low image density region. The lowest limit in the low image density region is determined by the reflection from a recording medium itself, such as a sheet of paper, on which the copy image is formed.

As is obvious from FIG. 2, the image density of a copy image increases substantially in proportion to the surface potential of the photosensitive member and finally reaches the upper limit, or the saturation level, which varies depending upon such factors as the color tone of toner particles and image fixing characteristics. As described above, the image density of a copy image increases substantially in proportion to the surface potential of the photosensitive member. Accordingly, when the gamma characteristic of an electrostatic latent image are changed due to changes in temperature of the photosensitive member, if development of a latent image is carried out by maintaining the same operating conditions, the image quality, in particular image density, of a copy image will be changed.

As shown in FIG. 1, in the case of an AsSe photosensitive member, the image density tends to be higher if the temperature of the photosensitive member is lower than the reference temperature, so that there is a likelihood of producing background contamination; on the other hand, if the temperature of the photosensitive member is higher than the reference level, the overall image density becomes lower. Thus, the quality of a resulting copy image may be maintained at constant to some extent by controlling the reproduction process such that the developing bias voltage is lowered in the case where the temperature of the photosensitive member is higher than the predetermined reference level and increased in the opposite case. Such a control method, however, is not always satisfactory, as will be fully understood later in comparison with the present invention.

Studying the curves indicating the characteristics of an AsSe photosensitive member as shown in the graph of FIG. 1 more in detail, it will be understood that when the temperature deviates from the reference level, changes of the surface potential in the lower image density region are larger than changes of the surface potential in the higher image density region. Thus, in order to prevent the occurrence of background contamination under the condition that the temperature of the photosensitive member is lower than the reference level, the developing bias voltage must be increased significantly in compensating the larger changes of characteristic in the lower image density region. However, this then brings about a relative reduction in image density in the higher image density region in the resulting copy image because changes of characteristic in the higher image density region are relatively smaller.

On the other hand, if the current temperature of the photosensitive member is higher than the reference temperature, since the surface potential in the lower image density region decreases significantly as compared with the other regions, reproducibility in the lower image density region is not enhanced even if the developing bias voltage is lowered, and, thus, reproducibility of an image is not enhanced in the case where the original image is low in density as well as in contrast.

In accordance with the present invention, in the case when the temperature of the photosensitive member is lower than the reference temperature of 25° C., the developing bias voltage is suitably varied; whereas, when the photosensitive member is higher in temperature beyond the reference level, the light amount of exposure is varied, so that changes in characteristic of the AsSe photosensitive member due to temperature variation may be compensated completely. With such a method, the occurrence of background contamination at lower temperatures may be avoided, and, at the same time, the reproducibility of a low contrast image at higher temperatures may be enhanced. Accordingly, the method of the present invention allows to carry out the control of a copying process more effectively as compared with the prior art method in which the same process variable such as the developing bias voltage as described above is varied.

In one embodiment of the present invention, which uses a photosensitive member having a reference temperature of 25° C., if the temperature of the photosensitive member is lower than the reference temperature of 25° C., the developing bias voltage $V_B$ is changed according to the following equation.

$$V_B = V_{B0} + K(T-25)$$

On the other hand, if the temperature of the photosensitive member is higher than the reference temperature of 25° C., the amount of exposure is varied according to the following equation.

$$E = AE_0(T-25)$$

In the above equations, the constants $V_{B0}$ and $E_0$ are predetermined reference values or operating conditions at the reference temperature. The factors K and A must be determined empirically for individual photosensitive members. However, for an AsSe photosensitive member, it has been found experimentally that the factor K in volts should preferably be selected from the range −15 V and −5 V, and the factor A in % should preferably be selected in the range between −2.8% and −1.4%. Thus, as the temperature decreases, the developing bias voltage increases; on the other hand, as the temperature increases, the amount of exposure decreases.

Even if the reproduction process including at least a step of uniformly charging the photosensitive member, a step of exposing a light image of an original image to the thus charged photosensitive member to form an electrostatic latent image thereon and a step of developing the latent image thereby converting it into a visual image is controlled as described above, the occurrence of a reduction in image density in the higher image density region when the temperature is lower than the reference temperature cannot be avoided. In order to prevent the occurrence of such a reduction in image density and thus to provide an enhanced control for the reproduction process, the amount of charges to be deposited for uniform charging may well be varied instead of changing the developing bias voltage when the detected temperature of the photosensitive member is lower than the reference level. Alternatively, it may be so structured to change not only the level of the developing bias voltage but also the charging amount.

Figure 3:
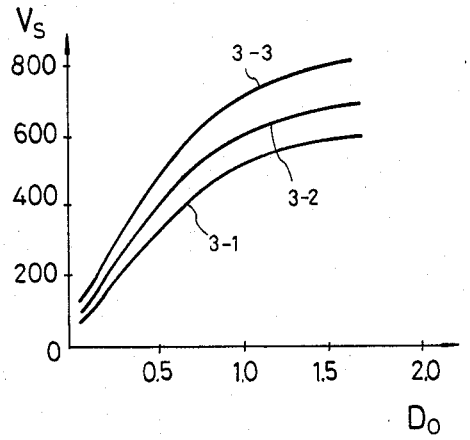
FIG. 3 is a graph showing the gamma characteristics for three different operating conditions of uniform charging for an AsSe photosensitive member with the abscissa taken for original image density $D_O$ and the ordinate taken for the surface potential $V_S$.

In FIG. 3, there are shown three curves in the graph whose abscissa is taken for the image density of an original image and ordinate is taken for the surface voltage of the photosensitive member. The curves 3-1, 3-2 and 3-3 show the gamma characteristics when the photosensitive member is charged to 600 V, 700 V and 800 V using charging current of 78 microampers/cm$^2$, 92 microampers/cm$^2$ and 106 microampers/cm$^2$, respectively. As is apparent from the graph of FIG. 3, if the temperature of the photosensitive member is lower than the reference level, an increased charging current may be used to increase the charging level, or alternatively, an increased developing bias voltage together with an increased charging current may be used to carry out the control of reproduction process more perfectly. It is to be noted that the results shown in FIG. 3 were obtained for the line speed of the photosensitive member at 120 mm/sec.

In the case of changing not only the developing bias voltage but also the charging level or amount in accordance with the present invention, when the developing bias voltage is changed in accordance with the above-described equation, the charging current I to be used for controlling the level of charging can be varied in accordance with the following equation with $I_0$ indicating the reference current at the reference temperature condition.

$$I = I_0 + C(25-T)$$

where the factor C in microampers is approximately in the range between −0.1 and −2 for a common photosensitive member including AsSe.

As described in detail above, by changing the kind or combination of process variables relating to an electrophotographic copying process to be changed depending upon whether the temperature of the photosensitive member is higher or lower than a predetermined reference temperature, a copying process may be carried out under more appropriate conditions thereby allowing to obtain a reproduced image of excellent quality at all times and not adversely affected by temperature changes.

Figure 4:
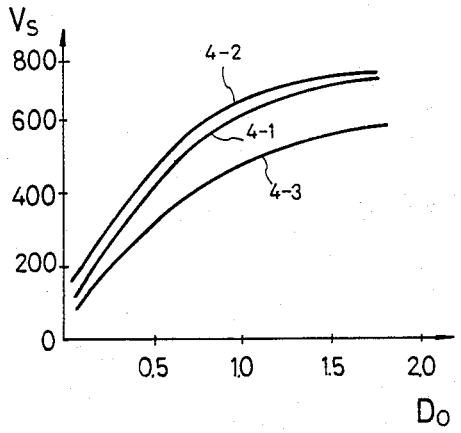
FIG. 4 is a graph showing the temperature dependent characteristics of a hologen doped Se-Te photosensitive member with the abscissa taken for original image density $D_O$ and the ordinate taken for surface potential $V_S$.

FIG. 4 shows the gamma characteristics of a photosensitive member which includes halogen doped SeTe as a photoconductive material. As shown, the curves 4-1, 4-2 and 4-3 correspond to the cases where the photosensitive member is at 25°, 15° and 35° C., respectively. In this case, when 25° C. is set as a reference temperature, in accordance with one mode of copying process control operation, if the temperature of the photosensitive member is lower than the reference temperature, then the developing bias voltage may be increased; on the other hand, if the temperature is higher than the reference level, the charging level may be increased. Alternatively, in accordance with another mode of the present copying process control operation, if the temperature is higher than the reference level, the developing bias voltage may be decreased with increasing the light amount of exposure at the same time; whereas, if the temperature is lower, the developing bias voltage may be increased. It should be noted that the amount of light exposure may be controlled easily by changing the level of current supply to one or more lamps for illuminating the surface of an original image, and that the charging level may be easily changed by suitably adjusting the level of voltage to be applied to a corona charging device.

Figure 5:
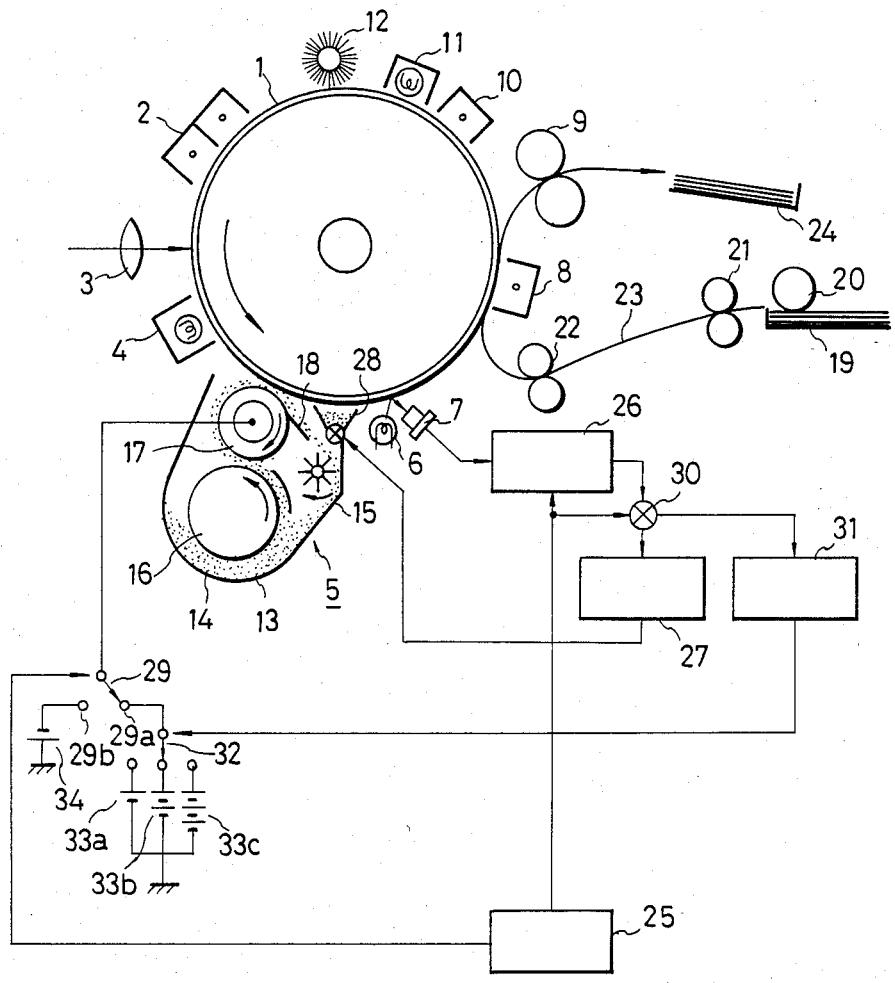
FIG. 5 is a schematic illustration showing the structure of an electrophotographic copying machine capable of controlling the density of a copy image.

FIG. 5 schematically shows the structure of an electrophotographic copying machine capable of maintaining the image density of a copy image at constant. As shown, a photosensitive drum 1 is rotatably supported and it is driven to rotate at constant speed in the direction indicated by the arrow. Various process units are disposed around the periphery of the photosensitive drum 1 and these process units include a corona charger 2, an image exposing optical system 3, an erasure lamp 4, a developing device 5, a toner deposition amount detector including a light emitting element 6 and a light receiving element 7, a corona transfer unit 8, an image fixing unit 9, a discharger corona unit 10, a discharger lamp 11 and a cleaning unit 12 in the counterclockwise direction in the order mentioned.

Thus, as the drum 1 is driven to rotate, the peripheral surface of the drum 1 is first uniformly charged to a predetermined polarity by the uniform corona charger 2, and a light image of an original image is exposed to the thus uniformly charged surface of the drum 1 through the exposing system 3 so that the charges are selectively dissipated to form an electrostatic latent image of the original image. Then the latent image is developed by attracting oppositely charged toner particles which are supplied from the developing unit 5. As is well known in the art, the developing unit 5 includes a container 14 containing therein a quantity of two component developer comprised of toner particles and carrier beads. While the developer is stirred by an impeller 15 and transported by a transport roller 16, the toner particles and carrier beads are mixed together and thus the toner particles become charged opposite in polarity to the latent image due to friction with the carrier beads. The developer is then transported from the transport roller 16 to a developing roller 17 from which only the toner particles are selectively attracted to the latent image on the drum 1 at the location where the developing roller 17 is closer to the drum 1. The remaining developer on the developing roller 17 after development is scraped off by a scraper 18 which is provided with its leading edge in scraping contact with the surface of the developing roller 17.

As the drum 1 rotates further, the developed image on the peripheral surface of the drum 1 enters into the transfer station where a transfer medium 23 supplied from a cassette 19 by means of rollers 20, 21 and 22 is placed on the developed image. Since transfer corona ions of the polarity opposite to that of the toner particles are deposited onto the back surface of the transfer medium 23, the developed or toner image is transferred to the front surface of the transfer medium 23 from the drum 1. After transfer, the transfer medium 23 is separated from the drum 1 to be passed through the fixing unit 9 and is discharged into a tray 24. On the other hand, the drum 1 moves past the corona discharger unit 10 and the discharger lamp 11 so that the residual charges remaining on the drum surface are removed. Finally, the surface is cleaned by the cleaner 12 and thus the residual toner particles are removed from the surface, thereby preparing the drum surface to be ready for the next cycle of operation.

In carrying out the image density control operation in the above-described electrophotographic copying machine, an image density detecting circuit 26 is first turned on by means of a timing generating circuit 25. In the illustrated embodiment of FIG. 5, it is normally set in a first mode of operation in which replenishment of toner particles is controlled by detecting the image density of a developed image. Stated more in detail in this respect, a reference reflection plate (not shown) is provided outside the image forming area of a contact glass plate for holding thereon an original document, and the light reflecting from the reference reflection plate when applied at the time of image exposure is projected onto that portion of the drum 1 outside of the image forming area to form its latent image. This latent image is also developed by the developing unit 5, and the amount of toner particles deposited by the developing unit 5 is detected by a detection unit comprised of the light emitting element 6 such as an LED and the light receiving element 7 such as a photodiode. In other words, the light emitted from the element 6 is received by the element 7 after having been reflected by the developed image located outside the image forming area of the drum 1, and thus the amount of deposited toner particles causes to change the amount of light received by the element 7, which is then converted into an electrical signal having the information as to the amount of toner deposited, i.e., image density.

Such an electrical signal is then supplied to the density detecting circuit 26 in which the thus supplied signal is compared with a reference voltage indicating a reference density to determine whether the detected density is higher or lower than the reference level. Under the circumstances, if it has been found that the deposited toner amount is lower than the reference level, then a signal is supplied to a toner replenishment control circuit 27, which then operates to replenish a predetermined amount of toner particles stored in a toner replenishing unit 28 provided integrally with the developing device 5 into the developer container 14, thereby causing to increase the toner concentration of the developer 13.

Under the normal condition, the image density control of a developed image is carried out as described above. However, in the case where a reduction of image density is detected even if a sufficient amount of toner particles has been replenished, the mode of operation is switched from the first mode to a second mode. Described more in detail, in response to a signal from the timing generating circuit 25, a bias voltage changeover switch 29 for applying a bias voltage to the developing roller 17 is switched to a contact **29*b* from the other contact 29*a*, and, at the same time, a mode selector 30 causes an output from the density detecting circuit 26 to be supplied to a bias changeover control circuit 31 instead of the toner replenishment control circuit 27. The contact 29*a* of the switch 29 may be connected to one of three bias voltage sources 33*a*, 33*b* and 33*c*, which are different in voltage level but same in polarity, through another bias changeover switch 32 which is switched in response to a signal supplied from the circuit 31. It is to be noted that one of the three bias voltage sources 33*a*, 33*b* and 33*c* is connected to the developing roller 17 during the normal image forming operation and the first mode of operation, so that the developing roller 17 receives the bias voltage which is slightly higher than and same in polarity as the voltage of the background area of an electrostatic latent image formed on the drum surface. The bias voltage is thus opposite in polarity to the charges of the toner particles. This allows to prevent the toner particles from being deposited on the background area of the image, and thus a copy free of background contamination may be obtained. On the other hand, to the contact 29*b* is connected a bias voltage source 34 which is reversed in polarity as compared with the other bias voltage source 33**.

In the second mode of operation of the embodiment shown in FIG. 5, the peripheral surface of the drum 1 is first uniformly charged to a predetermined polarity by means of the corona charger 2. Thereafter, with or without an image exposure by the image exposing system 3, the surface of the drum 1 is subjected to blanket exposure by means of the erasure lamp 4. As a result, the surface potential of the drum surface is set to the saturating residual potential which is substantially zero volt. Under the condition, when the thus blanket-exposed surface is developed by the developing roller 17 to which the reversed bias voltage is applied from the voltage source 34, the toner particles are attracted to the photosensitive surface following the potential difference between the roller 17 and the drum 1. The amount of thus deposited toner particles are then detected by the detector comprised of the elements 6 and 7 and its detecting signal is supplied to the circuit 26 where the detecting signal is compared with a reference voltage which indicates the reference toner deposition amount for the second mode of operation, thereby determining whether the detected toner amount is higher or lower as compared with the reference level.

Since only a few or several tens of millimeter long toner deposition region is required for this purpose, it is preferable to so structure that the application of the reversed bias voltage is discontinued, or, alternatively, the rotation of developing roller 17 or transport roller 16 is terminated after elapsing a predetermined time period in order to prevent unnecessary development from taking place. As an alternative method, the voltage, which is reversed in polarity as compared with the normal image processing operation, may be applied to the corona charger 2 with its opening partly blocked to form a non-charged, zero potential area and a reversely charged area on the photosensitive surface, and these areas are developed by the reverse-biased roller 17 to have the toner particles deposited only on the non-charged area.

Upon detection of the deposited toner amount in the second mode of detecting operation, the detected amount is compared with the reference amount, and when it is found that the detected amount is larger than or equal to the reference amount, it indicates that the first mode of detecting operation is malfunctioning because a reduction of image density is detected by the first mode of operation despite the fact that the toner particles have been replenished. In this event, since the second mode of operation is mainly concerned with the developing characteristics, the causes of malfunctioning may be found in other areas such as charging characteristics and exposure characteristics. For example, by inspecting the corona charger 2 as to its contamination or the like, the causes of malfunctioning are removed to bring the first mode of operation in good order.

As an alternative method, in response to a signal from the circuit 31, the developing bias voltage to be used in the first mode of operation is switched, for example, from the voltage source 33*b* to the lower voltage source 33*a*. By so doing, since the amount of toner particles deposited onto the photosensitive, or drum surface, is relatively increased, the measurement in the first mode of operation also causes an increase in image density, and thus a difference with the second mode of operation becomes smaller. However, such a method should preferably be used only when a large difference in detected values between the first and second modes of operation exists.

The above description relates to the case where a reduction in image density is detected in the first mode of detecting operation though toner particles have been replenished to the developer on the basis of the measured result of the first mode of operation. On the other hand, in the case where an increase or the reference condition is detected in the first mode of detecting operation though toner particles have not been replenished, the presence of malfunction in the first mode of detecting operation due to deterioration of the charging or exposure characteristics may be determined by correctly finding a decrease in image density by carrying out the second mode of detecting operation. Once detected, an appropriate measure may be taken easily to bring the first mode back in good order. If the second mode of operation has been found to malfunction, the copying machine is powered down immediately and inspection should be made to every component, or, alternatively, the control of toner replenishing amount which has been used in the first mode of operation is deactivated, and, if provided, the copying machine is switched into a mechanically controlled, fixed amount replenishing mode in which a fixed amount of toner particles is replenished in accordance with the number of copies made or the cumulative area of the copies made.

Figure 6:
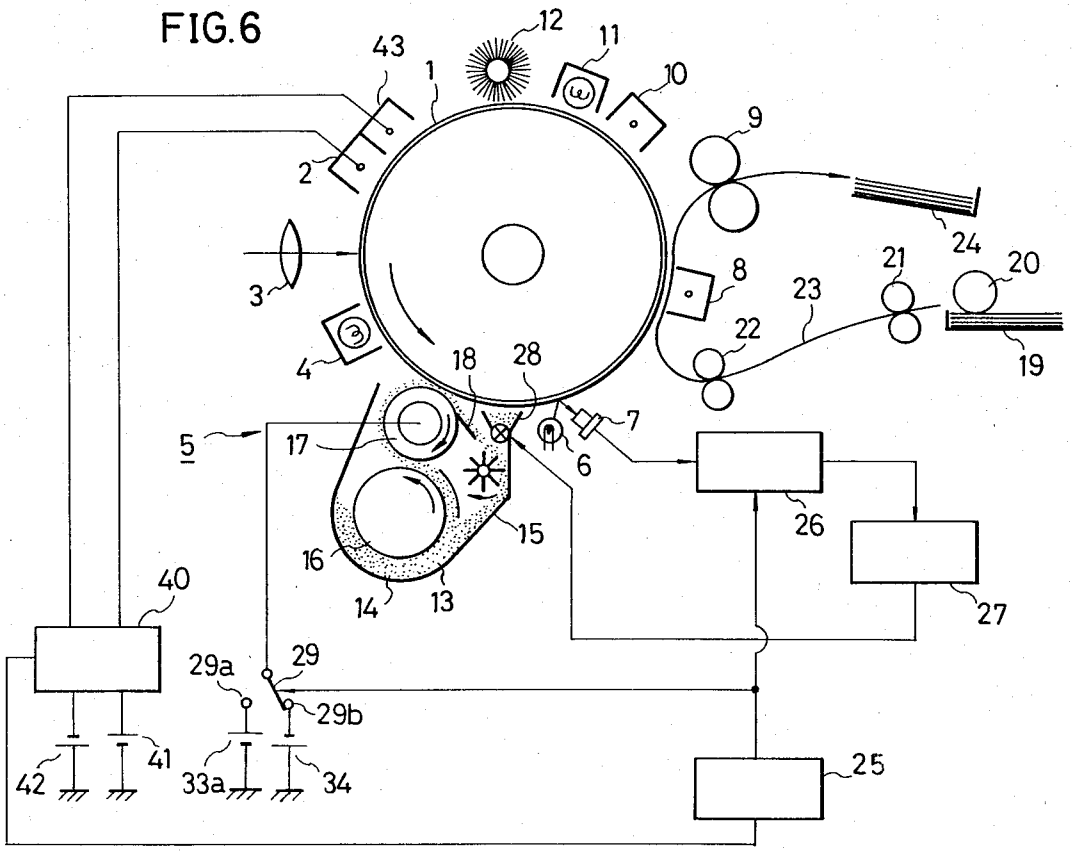
FIG. 6 is a schematic illustration showing the structure of another electrophotographic copying machine capable of controlling the density of a copy image.

FIG. 6 shows another electrophotographic copying machine capable of controlling the image density of a copy image. The structure shown in FIG. 6 has various components similar to those shown in FIG. 5, and thus identical numerals are used to indicate identical elements and the repeated description for the same elements will be omitted. As different from the structure of FIG. 5, the embodiment of FIG. 6 includes a reversing corona charger 43 which charges the drum or photosensitive surface in the polarity opposite to that of the charger 2. The ordinary image forming operation with regard to the embodiment of FIG. 6 does not differ from the one described previously with reference to the structure of FIG. 5.

Figure 7:
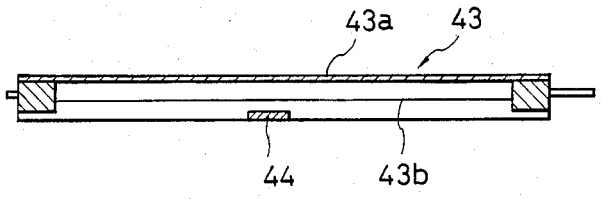
FIG. 7 is a longitudinal cross sectional view showing the structure of a corona charging device employed in the copying machine of FIG. 6.

When carrying out the image density control operation in the electrophotographic copying machine of FIG. 6, a signal is first supplied from the timing generating circuit 25 to the density detecting circuit 26 to have it activated, and, at the same time, a signal is supplied to a charging control circuit 40 to disconnect the voltage source 41, which is normally connected to the corona charger 2 in the ordinary image forming operation, from the corona charger 2 and connect the other voltage source 42, which is reversed in polarity with respect to the voltage source 41, to the reversing corona charger 43. As shown in FIG. 7, the reversing corona charger 43 includes a blocking plate 44 disposed in the opening of the shielding case 43*a*, or in front of the corona wire 43*b* toward the drum 1, and this blocking plate 44 blocks a part of the flow of charging ions. With this reversing corona charger 43 activated, the peripheral surface of the drum 1 is charged to the polarity opposite to the polarity of the uniform charges, which are deposited on the drum surface in the normal image forming process, excepting that portion of the drum surface which is opposite to the blocking plate 44 because the charging ions are prevented from reaching the drum surface in that portion.

Simultaneously with the above-described step of switching from charger 2 to charger 43, the bias voltage changeover switch 32 connected to the developing roller 17 is switched to connect the contact 29*b* from the contact 29*a* in response to a signal from the timing generating circuit 25. The contact 29*a* is connected to the bias voltage source 33*a*, which normally supplies, during the normal image forming operation, the bias voltage, which is slightly higher than and same in polarity with the background voltage of an electrostatic latent image formed on the photosensitive surface of the drum 1, to the developing roller 17. Therefore, the background area of a latent image on the drum surface is prevented from being developed, which thus allows to avoid the occurrence of background contamination on a copy sheet. On the other hand, the contact 29*b* is connected to the voltage source 34 which is same in polarity as the polarity of the charged toner particles. Thus, when the developing roller 17 is connected to the voltage source 34 through the switch 29, the toner particles will be deposited only to the zero potential portion of the drum surface. This reversed bias voltage is preferably set in the range between −200 V and −400 V in terms of selective deposition of toner particles to the photosensitive surface as well as density measurement under the condition that the toner particles are charged to negative polarity and the potential of the reversely charged portion of the photosensitive surface is at least −500 V, preferably in the range between −500 V and −800 V.

The toner particles thus deposited onto the zero potential portion of the drum surface are then detected by the detector comprised of the light emitting diode 6 and the photodetector 7. The deposited toner amount information is converted into an electrical signal by the photodetector 7, and this electrical signal is then supplied to the density detecting circuit 26 where the level of the thus supplied electrical signal is compared with a predetermined reference voltage indicating the reference amount of deposited toner particles, thereby determining whether the detected toner amount is larger or smaller than the reference amount. In the case where the detected toner amount is found to be less than the reference amount, a signal is supplied to the toner replenishing control circuit 27 to have it activated so that a predetermined amount of toner particles contained in the toner replenishing device 28 is replenished into the container 14 thereby increasing the toner concentration of the developer 13. Thereafter, the detection for the amount of deposited toner particles is once again carried out, and if an increase in the amount of deposited toner particles is not detected despite the fact that the toner particles have been replenished, then it can be judged that other process variables than the toner concentration of the developer must be adjusted in order to obtain a copy image of excellent quality. The other process variables include the charging amount or level of the toner particles, the level of the developing bias voltage, developing time, developing gap between the roller 17 and the drum 1, the rotational speed of the developing roller 17, etc.

Figure 8:
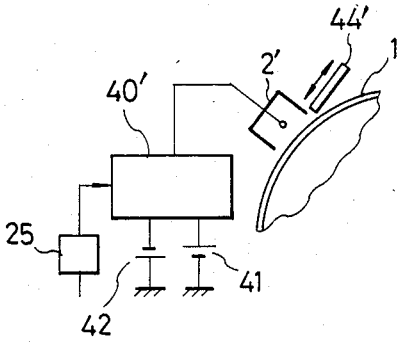
FIG. 8 is a schematic illustration showing a modification of the copying machine of FIG. 6.

In the above-described embodiment, the corona charger 30 is separately provided for charging the photosensitive surface to the reversed polarity in the image density control mode of operation. It should be noted, however, that it may be so structured to use the charger 2 for this purpose by changing the polarity of the voltage to be applied to the corona wire of the charger 2 instead of providing the charger 43 separately. That is, as shown in FIG. 8, a movable blocking plate 44' is provided in the vicinity of the charger 2' such that the plate 44' may be moved in front of the charger 2' to block the opening of the charger 2' partly, and there is provided a charging control circuit 40' which may selectively connect one of the bias voltage sources 41 and 42 to the corona charger 2'. During the normal image forming process, the charger 2' is connected to the voltage source 41 with the blocking plate 44' moved away from the opening of the charger 2'; whereas, during the image density control operation, the charger 2' is connected to the voltage source 42 via the control circuit 40' with the blocking plate moved in front of the charger 2' to partly block its opening, whereby zero potential and reversely charged portions are formed on the photosensitive surface of the drum 1.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A method for controlling a copying process, which uses a photosensitive member and includes at least the steps of uniformly charging said photosensitive member, exposing an image to the thus charged photosensitive member to form an electrostatic latent image thereon and developing the latent image, by changing process variables regarding said copying process depending upon the temperature of said photosensitive member, said process variables to be changed including at least the amount of uniform charging, the amount of exposure and the level of developing bias voltage and a reference temperature being predetermined for said photosensitive member, said method comprising the steps of:

detecting the temperature of said photosensitive member to determine whether the detected temperature is higher or lower than said predetermined reference temperature; and changing a first group of process variables when the detected temperature has been found to be higher than said reference temperature; whereas, changing a second group of process variables different in combination from said first group of process variables when the detected temperature has been found to be lower than said reference temperature.

2. A method of claim 1 wherein said photosensitive member includes AsSe as a photoconductive material, and said first group of process variables includes the amount of exposure; whereas, said second group of process variables includes the level of developing bias voltage and the amount of uniform charging.

3. A method of claim 2 wherein the amount of exposure is decreased from a predetermined reference amount when the detected temperature has been found to be higher than said reference temperature; whereas, the level of developing bias voltage is increased from a predetermined reference level and at the same time the amount of uniform charging is increased from a predetermined reference amount when the detected temperature has been found to be lower than said reference temperature.

4. A method of claim 1 wherein said photosensitive member includes halogen doped Se-Te as a photoconductive material, and said first group of process variables includes the level of developing bias voltage; whereas, said second group of process variables includes the amount of uniform charging.

5. A method of claim 4 wherein the level of developing bias voltage is increased from a predetermined reference level when the detected temperature has been found to be higher than said reference temperature; whereas, the amount of uniform charging is increased from a predetermined reference amount when the detected temperature has been found to be lower than said reference temperature.

* * * * *